US005740748A

United States Patent [19]

Morita

[11] Patent Number: 5,740,748

[45] Date of Patent: Apr. 21, 1998

[54] EMBROIDERY STITCHING DEVICE CAPABLE OF SIMULTANEOUSLY PERFORMING STITCHING A COMPUTATION OF STITCHING TIME

[75] Inventor: Nami Morita, Nagoya, Japan

[73] Assignee: Brother Kogyo Kabushiki Kaisha, Nagoya, Japan

[21] Appl. No.: 734,547

[22] Filed: Oct. 21, 1996

[30] Foreign Application Priority Data

Oct. 20, 1995 [JP] Japan ..... 7-297685

[51] Int. Cl.[6] ..... D05C 5/04; C05B 21/00

[52] U.S. Cl. ..... 112/102.5; 112/445

[58] Field of Search ..... 112/102.5, 103, 112/470.06, 475.19, 454, 445, 456, 458, 470.02

[56] References Cited

U.S. PATENT DOCUMENTS

| | | | |
|---|---|---|---|
| 5,228,403 | 7/1993 | Sugimoto | 112/102.5 X |
| 5,347,940 | 9/1994 | Hori et al. | 112/445 X |
| 5,474,002 | 12/1995 | Goto et al. | 112/103 X |

FOREIGN PATENT DOCUMENTS

| | | |
|---|---|---|
| A-62-57585 | 3/1987 | Japan . |
| A-62-57588 | 3/1987 | Japan . |
| A-7-185160 | 7/1995 | Japan . |

*Primary Examiner*—Peter Nerbun
*Attorney, Agent, or Firm*—Oliff & Berridge

[57] ABSTRACT

Based on pattern display data stored in a card ROM, a predetermined number of embroidery pattern examples are displayed in a display unit of a sewing machine. Upon selection of a desired embroidery pattern, computation of a stitching period of time for the selected embroidery pattern is automatically commenced. During the computation of the stitching period of time, a stitching routine is executed through an interval interrupt process. Upon completion of computation of the stitching period of time, the computed stitching period of time is numerically displayed in a position corresponding to the selected embroidery pattern. Because the computation of the stitching period of time and stitching of the selected embroidery pattern are simultaneously performed, the stitching procedure can be efficiently prosecuted.

17 Claims, 12 Drawing Sheets

EMBROIDERY STITCHING DEVICE CAPABLE OF SIMULTANEOUSLY PERFORMING STITCHING A COMPUTATION OF STITCHING TIME

BACKGROUND OF THE INVENTION

1. Field of the Invention

The present invention relates to an embroidery stitching device, and more particularly to such a device wherein when a desired embroidery pattern is selected from a plurality of embroidery patterns displayed in a display unit, stitching of the selected embroidery pattern and computation of a stitching period of time for the selected embroidery pattern are simultaneously commenced.

2. Description of the Related Art

Thee has been known an electrically controlled sewing machine having an embroidery device, which serves as an embroidery stitching device. A non-volatile memory for use in conjunction with the embroidery device stores pattern data for stitching a plurality of different categories of embroidery patterns, such as ornamental embroidery patterns, one point embroidery patterns, character embroidery patterns, end other embroidery patterns. The sewing machine is provided with a display unit having a large liquid crystal display. The display unit displays embroidery pattern examples belonging to a selected embroidery category when an operator depresses a category selection key. From the embroidery pattern examples displayed in the display unit, the operator can select a desired embroidery pattern. Recent sewing machines are further capable of displaying a stitching period of time for the selected embroidery pattern.

Japanese Laid-Open Patent Publications Sho-62-57585 and Sho-62-57588 disclose displaying a stitching period of time in a liquid crystal display (LCD) computed based on stitching data stored in a PROM. The stitching period of time is given by a sum of a stitch involving time involved in stitching and a fabric feeding time for feeding a fabric workpiece without stitching. The stitch involving time is computed by multiplying one seem forming period of time and a stitch number derived from the corresponding stitching data. The fabric feeding time is computed by multiplying the fabric feeding number and a time for each fabric feeding. Stitching of the embroidery pattern is commenced upon notifying the operator of the stitching period of time thus computed. The displayed stitching period of time may be determined to include a period of time for attaching and detaching a fabric workpiece.

The above-described conventional sewing machines are inconvenient because stitching of the selected embroidery pattern is not commenced until the stitching period of time or the total period of time needed for stitching the selected embroidery pattern is computed and displayed in the display unit. Therefore, for the embroidery pattern formed from a large number of stitches, a long waiting time will be posed before start of stitching. As a result, a cycle time from the start to the end of each embroidery stitching is unduly prolonged, thereby lowering the efficiency of the stitching operation.

SUMMARY OF THE INVENTION

The present invention has been made to eliminate the aforementioned inconvenience of the conventional sewing machines, and accordingly it is an object of the present invention to provide an embroidery stitching device wherein when a desired embroidery pattern is selected, stitching of the selected embroidery pattern and computation of a stitching period of time for the selected embroidery pattern are simultaneously commenced, thereby increasing the efficiency of the embroidery stitching operations.

In order to achieve the above and other objects, there is provided, according to one aspect of the present invention, an embroidery stitching device that includes a display unit, data storage means, embroidery stitching means, stitching control means, pattern display control means, pattern selection means, stitching start instruction means, time computing means and time display control means. The data storage means is, for example, a card ROM, which stores a plurality of pieces of pattern data. Each of the plurality of pieces of pattern data contains a plurality of pieces of embroidery data regarding a plurality of embroidery patterns. Each of the plurality of embroidery patterns is stitched by at least one color thread. The embroidery stitching means is provided for stitching an embroidery pattern in a workpiece cloth, which includes a stitching mechanism provided with a needle, and a workpiece cloth moving mechanism for moving the workpiece cloth relative to the stitching mechanism. The stitching control means controls the embroidery stitching means so that the embroidery pattern is stitched in the workpiece cloth based on corresponding embroidery data stored in the data storage means. The pattern display control means is provided for displaying a predetermined number of embroidery patterns in the display unit based on a selected one of the plurality of pieces of pattern data. The pattern selection means selects a desired embroidery pattern from the predetermined number of embroidery patterns displayed in the display unit. The stitching start instruction means instructs the stitching control means to start stitching when the desired embroidery pattern is selected with the pattern selection means. The time computing means computes a stitching period of time needed for stitching the desired embroidery pattern based on embroidery data corresponding to the desired embroidery pattern. In the present invention, the stitching period of time is computed in parallel relation with stitching of the desired embroidery pattern. In other words, computation of the stitching period of time and stitching of the desired embroidery pattern are performed in time sharing relation. For example, the stitching control means implements controlling of the embroidery stitching means through an interval interrupt during computation of the stitching period of time by the time computing means. The time computing means outputs time data representative of a computed stitching period of time. The time display control means displays the computed stitching period of time in the display unit based on the time data output from the time computing means.

The time computing means computes the stitching period of time for the desired embroidery pattern selected by the pattern selection means. The time display control means displays the computed stitching period of time in association with a corresponding embroidery pattern displayed in the display unit. When a plurality of embroidery patterns are sequentially selected by the pattern selection means, the time computing means computes the stitching period of time for each of the plurality of embroidery patterns selected by the pattern selection means. The time display control means displays the stitching period of time computed for each of the plurality of embroidery patterns selected by the pattern selection means in association with corresponding embroidery patterns displayed in the display unit.

According to another aspect of the present invention, a timing generator may be provided in addition to the embroidery stitching device described above. The timing generator is provided for defining an embroidery data read timing and a workpiece cloth move timing. At the embroidery data read timing, the embroidery stitching means reads embroidery data corresponding to the desired embroidery pattern from the data storage means and computes a moving distance of the workpiece cloth moving mechanism based on the embroidery data read from the data storage means. At the workpiece cloth move timing, the workpiece cloth moving mechanism moves the workpiece cloth by the moving distance computed. At timings other than the embroidery data read timing and the workpiece cloth move timing, the time computing means computes the stitching period of time.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 1:
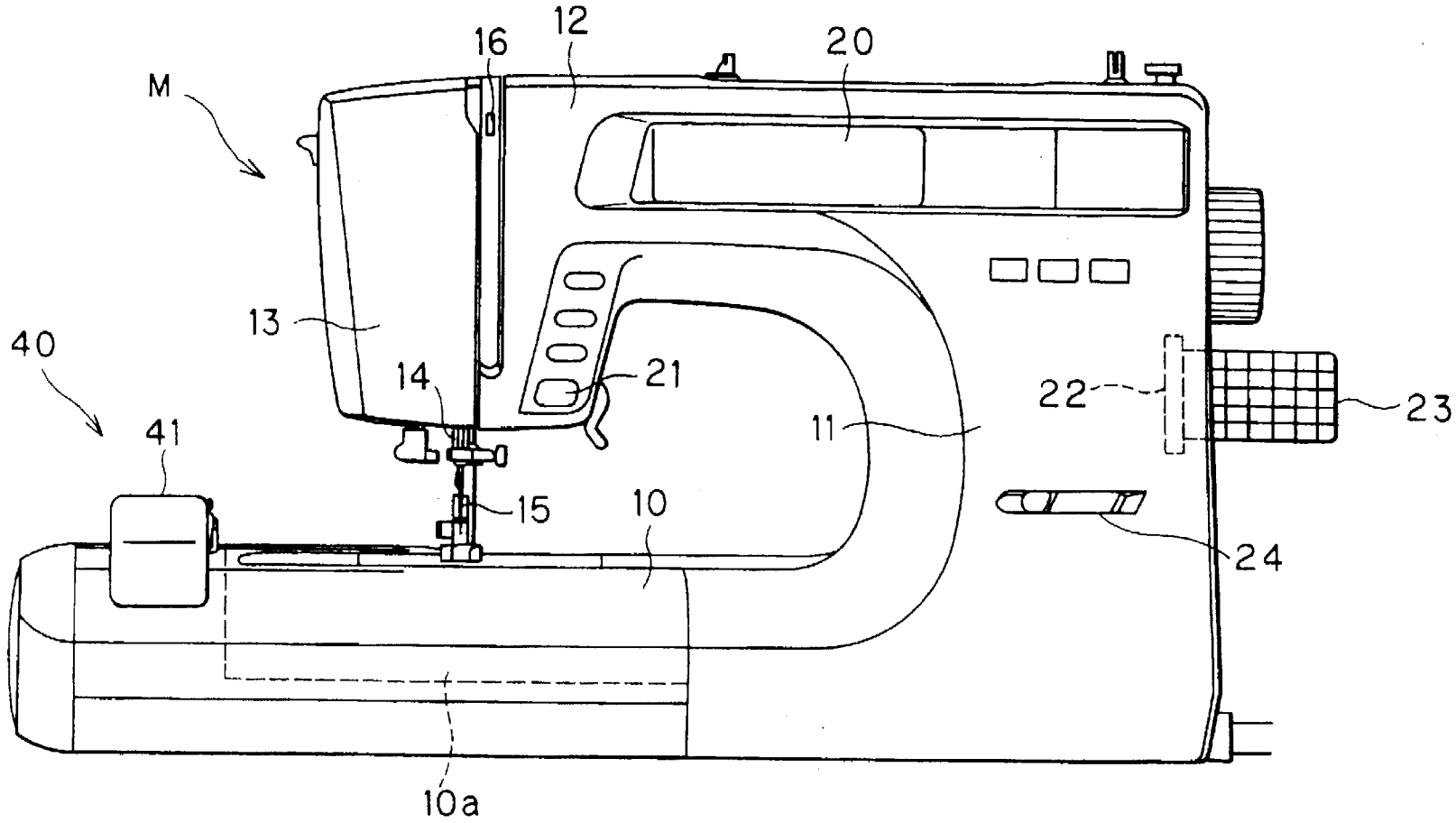
FIG. 1 a front view showing an embroidery stitching device according to an embodiment of the present invention.

A preferred embodiment of the present invention will be described with reference to the accompanying drawings. The embodiment is concerned with an embroidery stitching device. As shown in FIG. 1, the embroidery stitching device M includes an electrically controlled zigzag sewing machine having a needle 15, and a workpiece cloth feeding mechanism which is detachably mounted to the zigzag sewing machine.

The zigzag sewing machine 1 includes a bed portion 10; a column portion 11 provided with an upright posture at the right tip portion of the bed portion 10 as viewed in FIG. 1; and an arm portion 12 extending from the column portion 11 leftward as viewed in FIG. 1 in parallel with the bed portion 10. Although not shown in the drawings, a feed dog vertical movement mechanism for vertically driving a feed dog and feed dog horizontal movement mechanism for horizontally driving the feed dog are provided to the bed portion 10.

Figure 2:
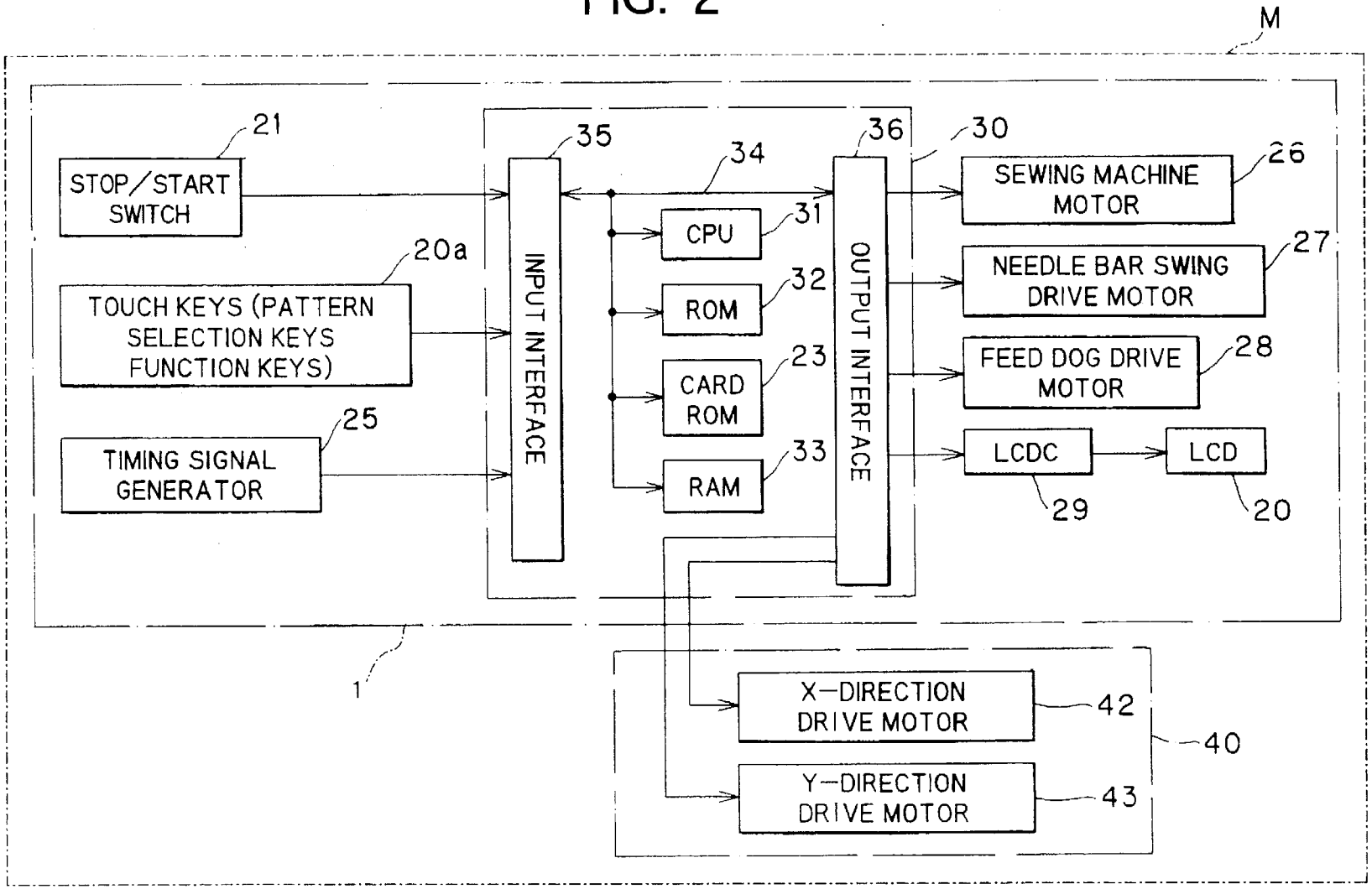
FIG. 2 is a block diagram showing a control system for the embroidery stitching device.

Although not shown in the drawings, the arm portion 12 is provided with a needle bar drive mechanism for vertically driving a needle bar 14 with a needle 15 mounted to its lower tip; a needle bar swinging mechanism for swinging the needle bar 14 in a direction perpendicular to the direction in which a workpiece cloth is fed; and a thread take up lever mechanism (not shown) for vertically driving a take up thread lever 16 in timed relation to vertical drive of the needle bar 14. As shown in FIG. 2, a sewing machine motor 26 is provided for driving the needle bar drive mechanism, the thread take up lever drive movement mechanism, and the feed dog vertical movement mechanism; a needle bar swing drive motor 27 is provided for driving the needle bar swing mechanism; and a feed dog drive motor 28 is provided for driving the feed dog horizontal movement mechanism.

A liquid crystal display unit 20 capable of displaying a plurality of embroidery patterns and a variety of messages is provided to the front surface of the arm portion 12. A plurality of touch keys **20*a* formed from transparent electrodes are provided to the display regions of display unit 20. The touch keys 20*a* serve as pattern selection keys for selecting patterns from embroidery patterns displayed on the display unit 20 and also as function keys displayed with function names. A start/stop switch 21 for commanding start and stop of sewing operations is provided in the vicinity of a head portion 13 of the arm portion 12. The column portion 11 is provided with a memory card mounting connector 22 for detachably mounting card ROMs 23, which serve as an external memory; end a speed changing knob 24** for adjusting sewing speed.

A free arm portion **10*a* is formed to the left tip of the bed portion 10. A workpiece cloth feeding device 40 capable of sewing large embroidery patterns is detachably mounted to the free arm portion 10*a*. An embroidery table 41 is provided to the workpiece cloth feeding device 40 so as to be movable in both a Y-direction in parallel to a workpiece cloth feeding direction and an X-direction perpendicular to the Y-direction. Although not shown in the drawings, a fabric holding frame for supporting the workpiece cloth can be detachably mounted to the embroidery table 41. An X-direction drive motor 42 for driving the embroidery table 41 in the X-direction and a Y-direction drive motor 43 for driving the embroidery table 41 in the Y-direction are provided within the workpiece cloth feeding device 40**.

Next, a control system of the sewing machine 1 and the workpiece cloth feeding device 40 will be described while referring to the block diagram shown in FIG. 2.

The control device 30 of the sewing machine 1 includes a microcomputer, an input interface 35, and an output interface 36. The microcomputer includes a CPU 31, a ROM 32, a card ROM 23, and a RAM 33. The input interface 35 and the output interface 36 are connected to the microcomputer via a bus 34, such as a data bus. Signals from the start/stop switch 21, the touch keys 20*a*, and a timing signal generator 25 are supplied to the microcomputer through the input interface 35. Drive signals and drive pulse signals for driving the sewing machine motor 26, the needle bar swing drive motor 27, the feed dog drive motor 28, and a liquid crystal display controller (LCDC) 29, which is for supplying display signals to the display unit 20, are supplied from the microcomputer through the output interface 36.

A disk is coaxially secured to an upper shaft (not shown) housed in the arm portion 12. A plurality of slits are formed in the peripheral portion of the disk to allow light to pass therethrough. The timing signal generator 25 is disposed to receive the light having passed through the slits of the disk. Each time the light is received at the timing signal generator 25, the latter outputs timing signals. The stitching operation is performed in accordance with the timing signal.

The output interface 36 is connected to the X-direction drive motor 42 and the Y-direction drive motor 43 of the workpiece cloth feeding device 40. The drive motors 42, 43 are independently driven based on separate drive signals output from the control unit 30 to move the embroidery table 41 to a particular position for each stitch using a combination of movements in the X- and Y-directions, thereby enabling sewing of a variety of embroidery patterns in the workpiece cloth supported in the cloth support frame. A stitching data processing device is constructed with the control unit 30, the display unit 20, and touch keys 20*a*.

Figure 3:
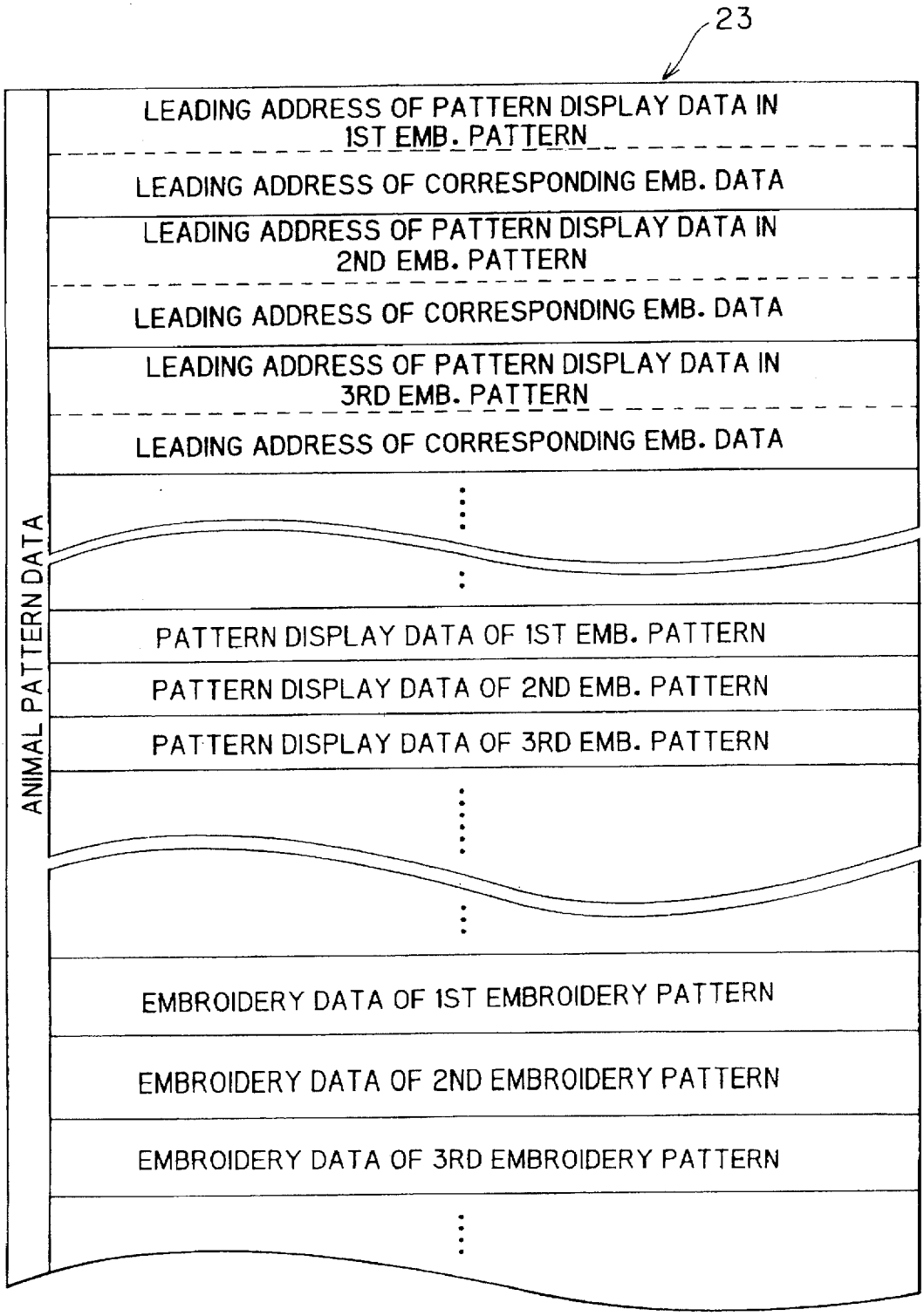
FIG. 3 is an explanatory diagram illustrating a structure of pattern data stored in a card ROM.

The card ROM 23 has stored therein pattern data including embroidery data for sewing, and pattern display data for displaying a variety of embroidery patterns that are classified into several groups, such as "animal" embroidery patterns including an elephant pattern and a horse pattern, "people" embroidery patterns, and "character/symbol" embroidery patterns including alphanumerals, and symbol marks. For example, as shown in FIG. 3, the pattern data regarding the "animal" embroidery patterns includes a leading address of pattern display data in a first embroidery pattern (panda), and a leading address of the first embroidery data, a leading address of pattern display data in a second embroidery pattern (elephant), and a leading address of the second embroidery data, a leading address of pattern display data in a third embroidery pattern (horse), and a leading address of the third embroidery data, and so on.

The pattern data of the first, second, third embroidery patterns and so on are sequentially stored in the card ROM 23, and the embroidery data corresponding to the first, second, third embroidery patterns and so on are also sequentially stored therein. The pattern display data and the embroidery data for the various embroidery patterns falling in the categories of "people" and "character/symbols" are also stored in the card ROM 23 on the category basis. The pattern display data and the embroidery data relating to the embroidery pattern constitute pattern data.

The embroidery data is representative of needle locations and is given by values on absolute or relative coordinates corresponding to a fabric supporting frame. Based on the embroidery data, the workpiece fabric is moved relative to a needle 14 by the workpiece cloth feeding device 40. The embroidery data may represent all of the needle positions or apex positions of blocks, such as a triangle, or rectangle, into which the embroidery pattern is divided.

The embroidery pattern can be divided into a plurality of pattern segments on a color basis so that the embroidery pattern may be stitched using different color threads. The pattern display data is constructed with plural pieces of segmental pattern display data. Thread change instruction data is added to the trailing portion of each segmental pattern display data for instructing the operator to stop stitching the embroidery for replacement of the thread.

The ROM 32 has stored therein control programs including an embroidery pattern display control program to be described later and a stitch control program. The stitch control program is for controlling the drive motors 27 and 28 based on embroidery data for performing zigzag stitches or triple stitches, or for controlling the drive motors 42 and 43 for performing embroidery stitches based on embroidery data. The RAM 33 is provided with buffers and counters which are necessary for executing the embroidery pattern display control and the stitch control.

An embroidery pattern/stitching time display process to be executed by the control device 30 of the sewing machine 1 will be described while referring to the flowcharts shown in FIGS. 4 through 8 wherein Si (I=10, 11, 12 . . . ) indicates individual step numbers of the routine.

Figure 10:
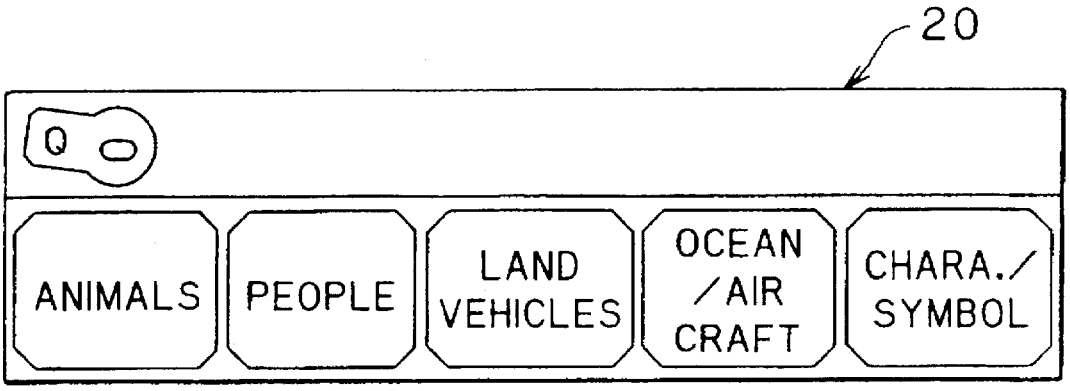
FIG. 10 is an explanatory diagram showing category names of stitchable embroidery patterns displayed in a display unit.

The routine starts when the sewing machine 1 is powered. First, a category selection screen is displayed in the display unit 20 for selection of a desired category of embroidery patterns (S10). For example, as shown in FIG. 10, the display unit 20 displays such categories as "Animals", "People", "Land Vehicles", "Ocean/Air Craft", and "Character/Symbol". A desired category can be selected upon depressing the corresponding touch key 20*a*, whereupon an embroidery pattern category selection process is executed (S11). When the selected category pertains to a one-point embroidery pattern (S12: Yes), then a one-point embroidery pattern display process (see FIG. 5) is executed (S14).

Figure 11:
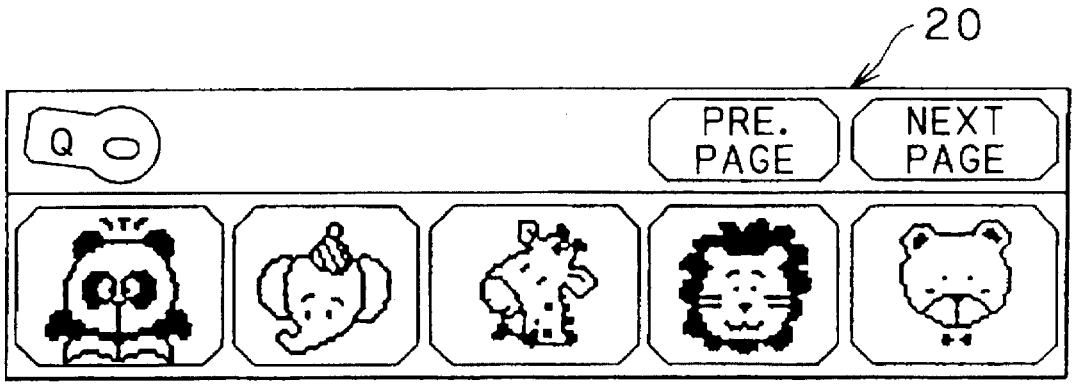
FIG. 11 is an explanatory diagram showing a set of animal embroidery patterns displayed in the display unit according to the embodiment of the present invention.

Upon start of this process, a first set of embroidery patterns belonging to the selected category is displayed in the display unit 20 (S20). When, for example, the category of "Animals" ie selected, the first five animal embroidery patterns corresponding to the first to fifth embroidery patterns stored in the card ROM 23 are displayed as shown in FIG. 11. In this example, the first embroidery pattern shows a panda, the second embroidery pattern an elephant, the third embroidery pattern a giraffe, the fourth embroidery pattern a lion, and the fifth embroidery pattern a bear.

When the touch key 20*a* corresponding to "Next Page" is depressed (S21, S22: Yes), next five animal embroidery patterns are displayed (S26), whereupon the routine returns to S21. When the touch key 20*a* corresponding to "Previous Page" is depressed (S21: Yes, S22: No, S23: Yes), the previous five animal embroidery patterns are displayed (S26), whereupon the routine returns to S21.

Figure 6:
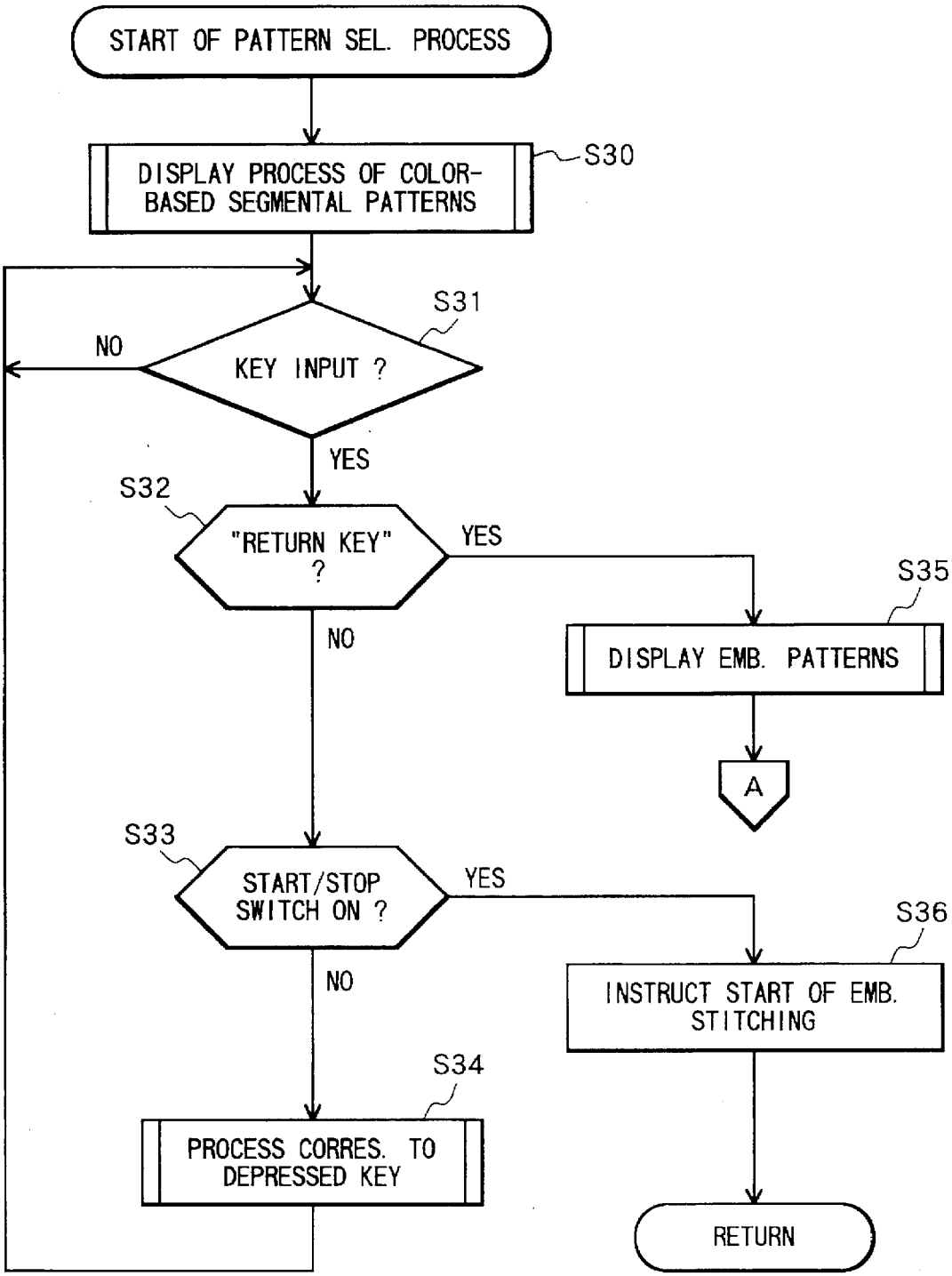
FIG. 6 is a flowchart illustrating a pattern selection control routine according to the embodiment of the present invention.
Figure 12:
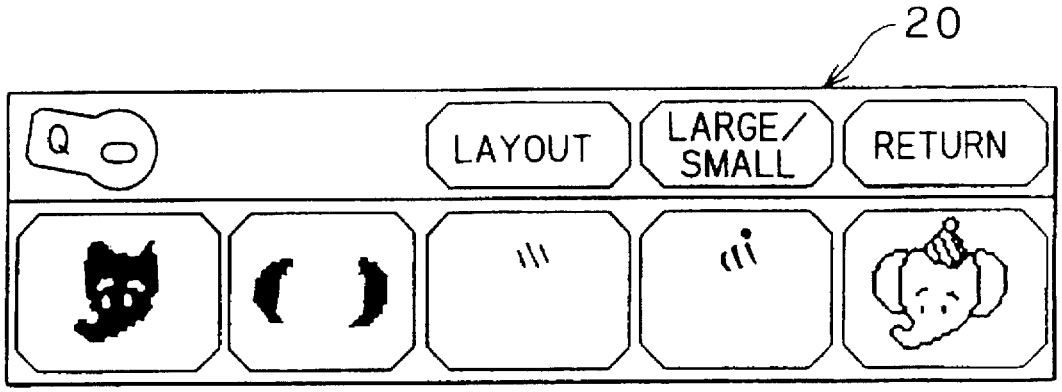
FIG. 12 is an explanatory diagram showing a display of color-based segmental pattern components making up an elephant embroidery.

When the touch key 20*a* corresponding to the desired embroidery pattern among those displayed in the display unit 20 is depressed (S21: Yes, S22, S23: No, S24: Yes), a pattern selection process as illustrated in the flowchart of FIG. 6 is executed (S27). When this process starts, pattern display data for the embroidery pattern as specified by the touch key 20*a* is read from the card ROM 23, end a plurality of color-based segmental patterns are sequentially displayed in an order of stitching (S30). For example, when the embroidery pattern of elephant is selected, five segmental patterns making up the embroidery pattern of the elephant are sequentially displayed as shown in FIG. 12.

When the return key is depressed (S31, S32: Yes), the embroidery patterns belonging to the currently selected category of the embroidery patterns are displayed in the display unit 20 (S35), whereupon the routine returns to S21 of the one-point embroidery pattern display process. In this condition, the operator can again select a desired embroidery pattern for the subsequent stitching.

On the other hand, when the keys other than the return key and the start/stop key 21 are depressed in the pattern selection process (S31: Yes, S32, S33: No), the process corresponding to the depressed key is executed (S34), whereupon the routine returns to S31. When the start/stop key 21 is depressed (S31: Yes, S32: No, S33: Yes), start of an embroidery stitching is instructed so as to drive the sewing machine motor 26, whereupon the routine of the pattern selection process and the one-point embroidery pattern display process are ended. Then, the routine returns to S16 of the embroidery/stitching time display process. As a result, the embroidery stitching is started by virtue of the combination of the embroidery stitching device and the workpiece cloth feed mechanism 40.

Figure 7:
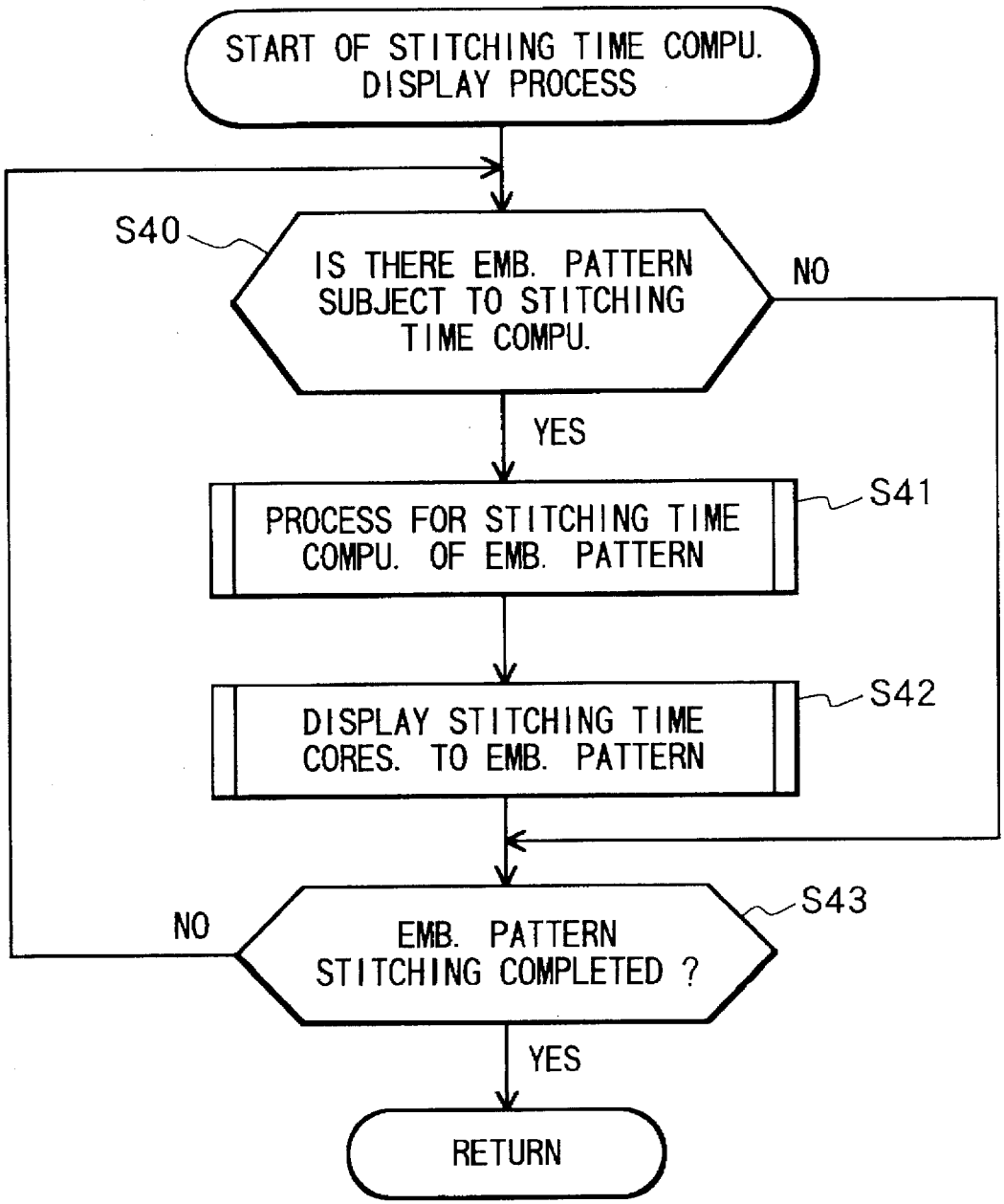
FIG. 7 is a flowchart illustrating a stitching time computation display control routine according to the embodiment of the present invention.

In the embroidery pattern/stitching time display process, a stitching time computation display process as shown in FIG. 7 is executed (S16). It is important to note that this stitching time computation display process is executed in parallel with stitching of the embroidery pattern. Interval interrupt is executed during the stitching time computation process so that stitching of the embroidery pattern can be executed during the interrupted interval. The interrupt is executed at every predetermined timing, for example, at every 1 msec, which timing is determined so that various kinds of timing signals used for stitching can be accurately detected while rotating the upper shaft as fast as possible. By doing so, the embroidery stitching process is executed in parallel relation with computation of the stitching period of time.

The stitching time computation display process will firstly be described. Upon start of this process, it is determined whether or not there is an embroidery pattern subject to the stitching time computation (S40). When there is such an embroidery pattern (S40: Yes), the stitching period of time for the first embroidery pattern is computed (S41). In this stitching time computation process, the stitching period of time for each of the embroidery patterns is computed based on the corresponding embroidery data and a stitching speed set for the embroidery pattern. Specifically, the stitching period of time is given by multiplying the number of stitches and a cycle time for one stitch. The stitching periods of time computed for all the embroidery patterns are displayed in positions corresponding to the embroidery patterns (S42). When the stitching of the embroidery pattern has not yet been completed (S43: No), (S40) and so on are repeatedly executed. When the stitching of the embroidery pattern is over (S43: Yes), this process is terminated end the routine returns to S10 of the embroidery pattern/stitching time display process.

Figure 9:
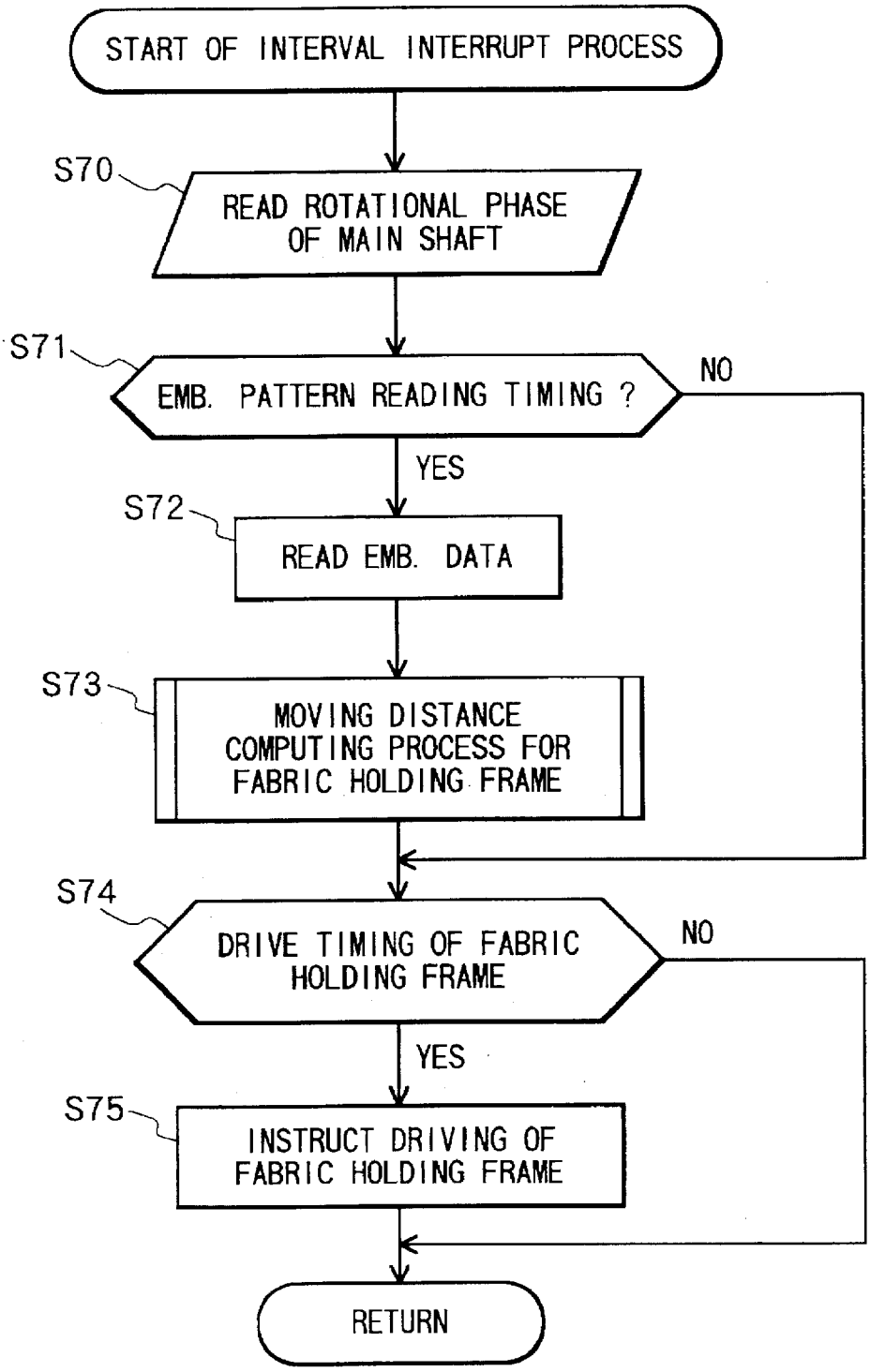
FIG. 9 is a flowchart illustrating an interval interrupt control routine according to the embodiment of the present invention.

Next, the interval interrupt process will be described while referring to the flowchart shown in FIG. 9. The embroidery stitching is interrupt-driven during the execution of the stitching time computation display process.

When the interval interrupt process is started, the rotational phase of the main shaft is read from the timing signal generator 25 (S70). If the rotational phase thus read does neither indicate the embroidery pattern reading timing (S71: No) nor indicate the driving timing of the fabric holding frame (S74: No), the interval interrupt routine is immediately terminated.

If the rotational phase of the main shaft indicates the embroidery pattern reading timing (S71: Yes), embroidery data for the next stitching is read (S72) and, based thereon, computation is performed to obtain an amount of movement of the fabric holding frame so that a subsequent needle position is determined (S73). If the rotational phase of the main shaft indicates the driving timing of the fabric holding frame (S74: Yes), instructions are issued to the X- and Y-direction drive motors 42 and 43 causing to move the fabric holding frame based on the amount of movement obtained in S73 (S75), whereupon the execution of this process is terminated.

Figure 13:
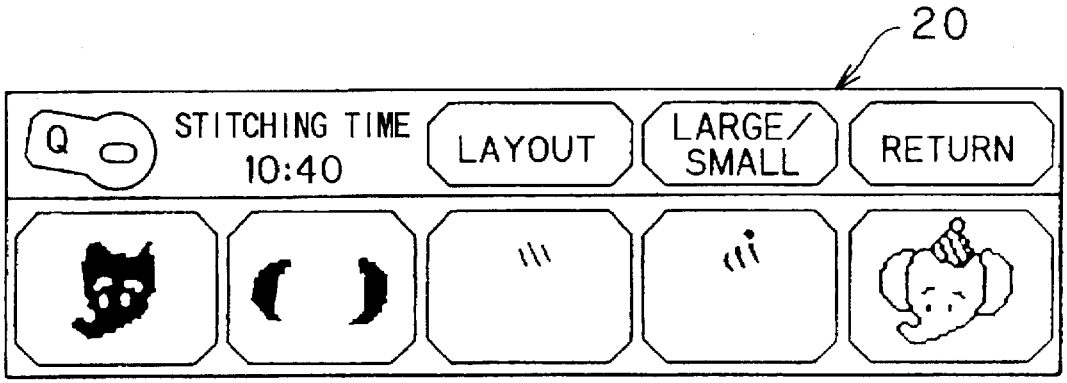
FIG. 13 is an explanatory diagram snowing a display of stitching times and the color-based segmental pattern components.

When the start/stop key 21 is depressed under the condition where the color based five segmental patterns of the elephant's embroidery pattern are displayed in the display unit 20 as shown in FIG. 12, the stitching mechanism is driven by the sewing motor 25 and also the workpiece cloth feeding device 40 Is driven by the X- and Y-direction drive motors 42 and 43 to thereby perform the embroidery stitching. In this manner, the embroidery stitching is executed in parallel relation to the execution of computation of the stitching time. Stated differently, the execution of the embroidery stitching and the computation of the stitching time are implemented in time sharing manner. Specifically, the execution of the embroidery stitching is interrupt-driven during computation of the stitching time. When the stitching period of time is computed, the resultant period of time is displayed in the display unit 20 in a position corresponding to the embroidery pattern specified as shown in FIG. 13.

Figure 4:
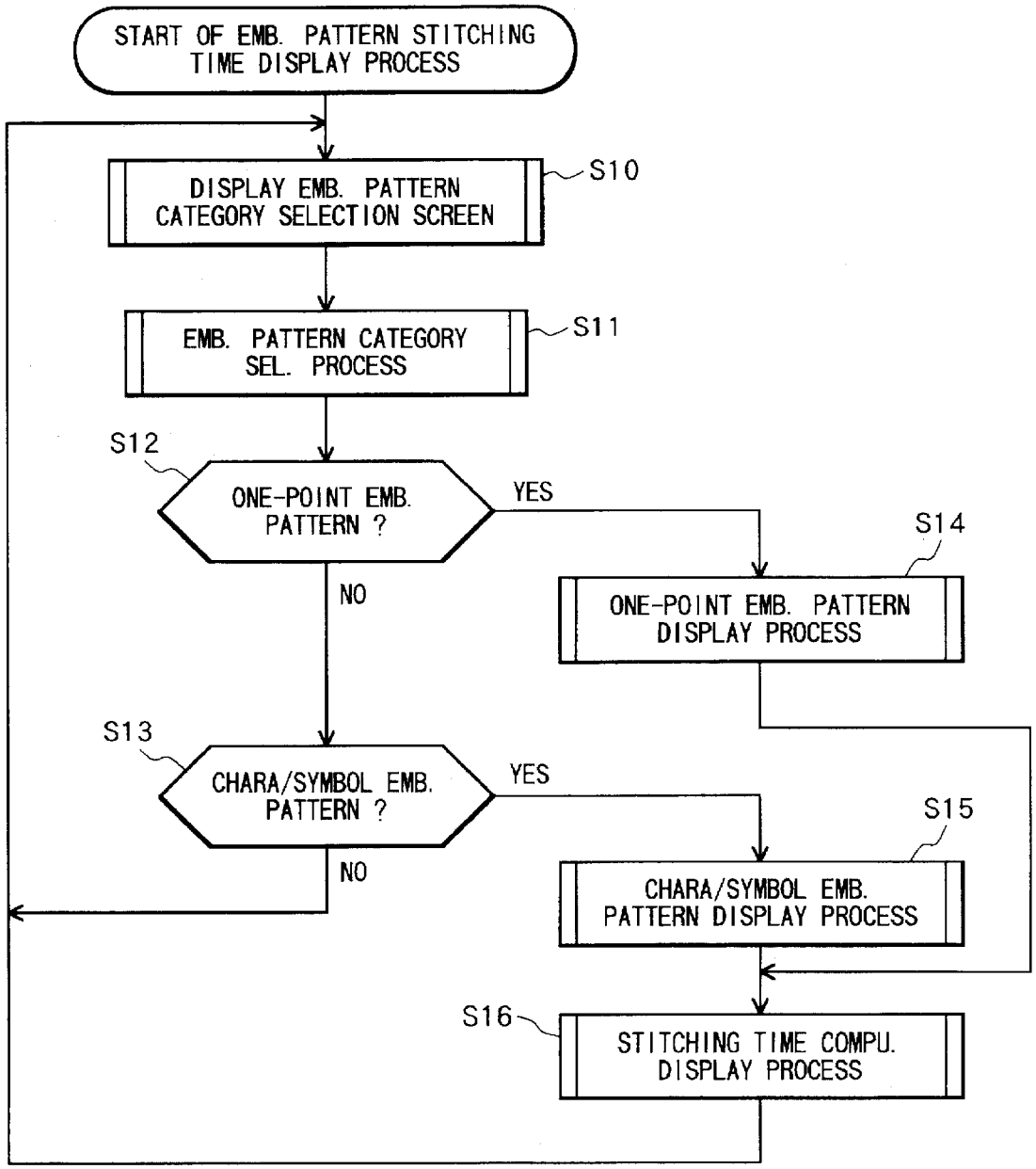
FIG. 4 is a flowchart illustrating an embroidery pattern stitching time display control routine according to the embodiment of the present invention.
Figure 5:
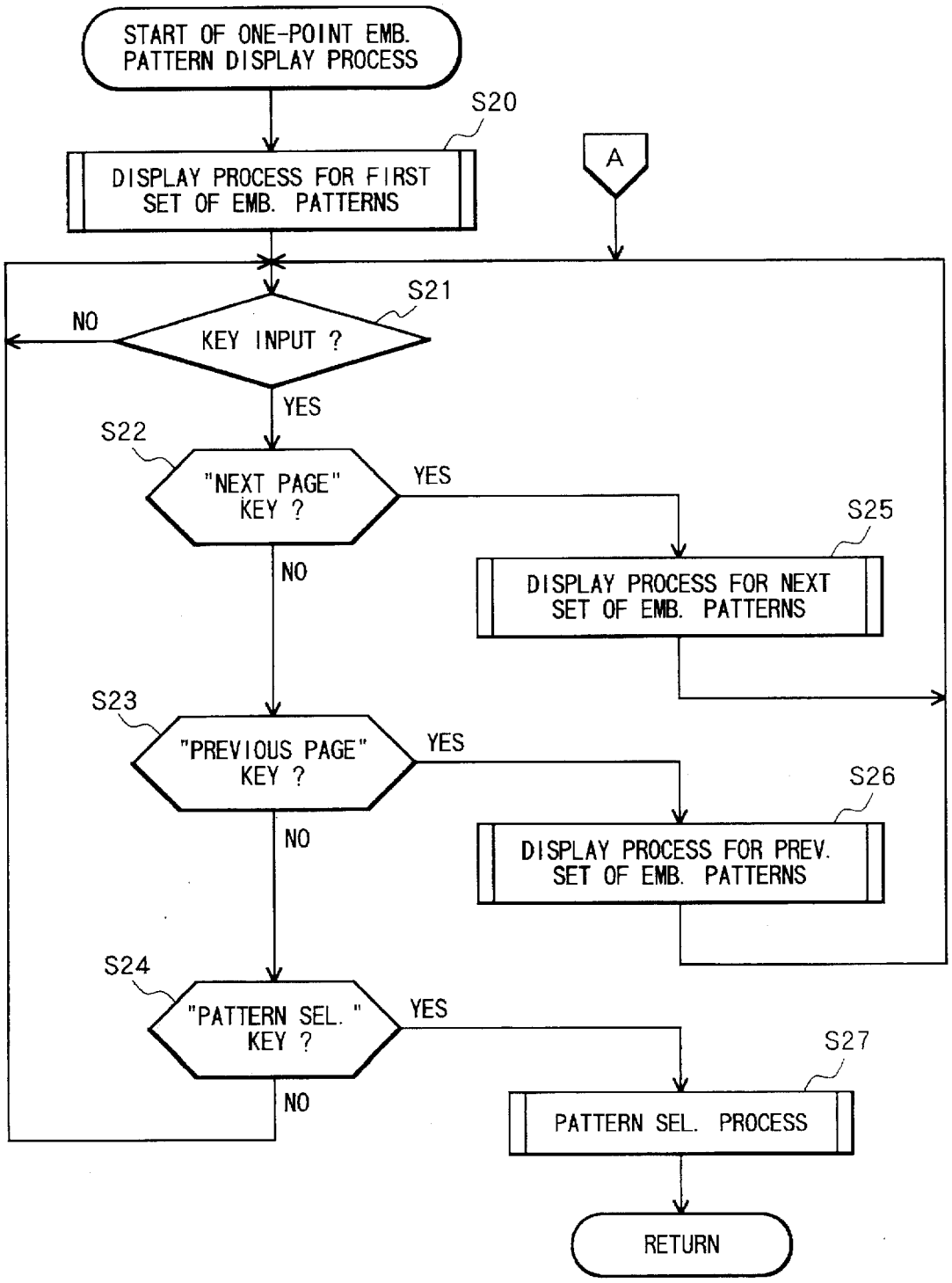
FIG. 5 is a flowchart illustrating a one-point embroidery pattern display control routine according to the embodiment of the present invention.
Figure 8:
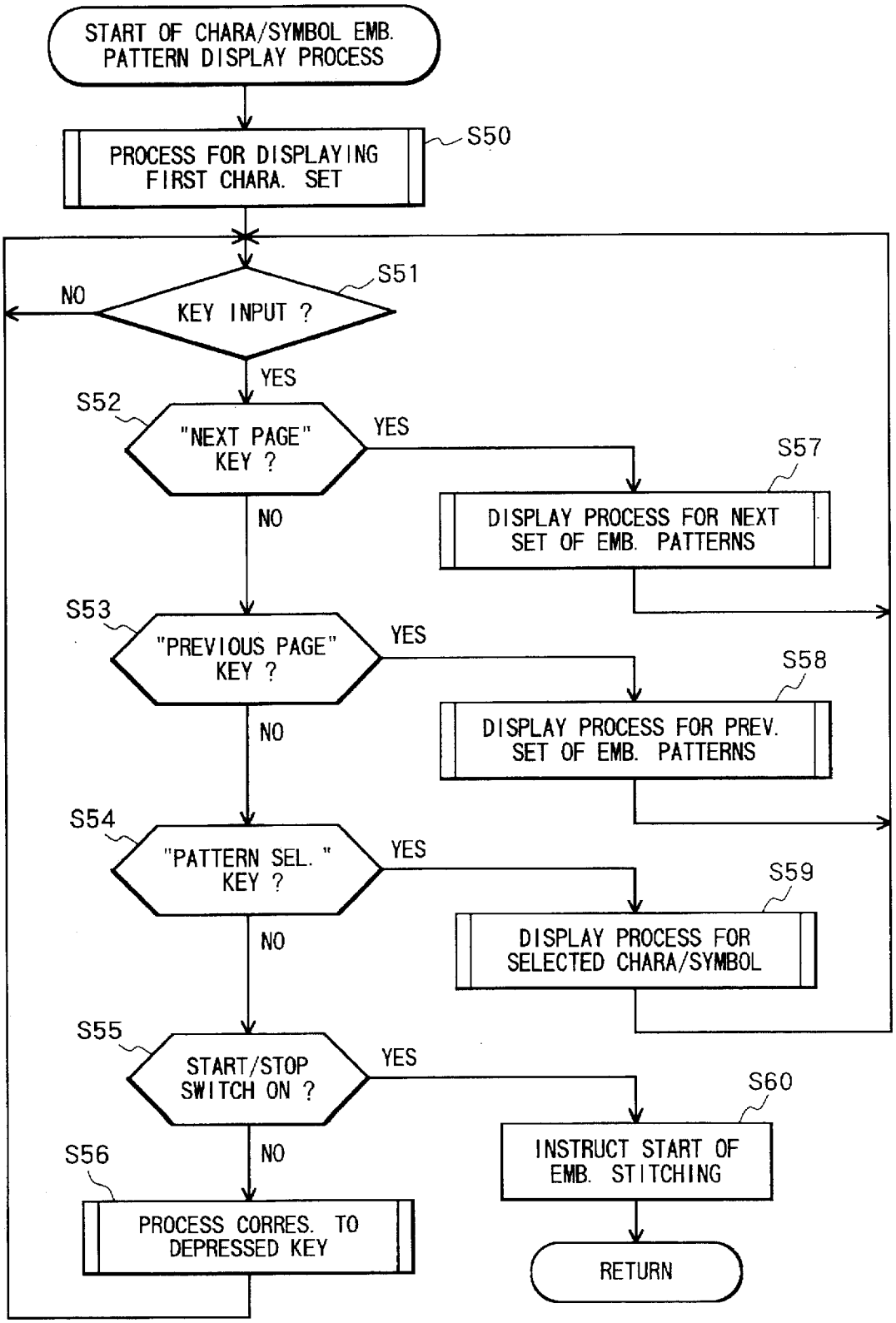
FIG. 8 is a flowchart illustrating a character/symbol embroidery pattern display control routine according to the embodiment of the present invention.

In the embroidery pattern/stitching time display process shown in the flowchart of FIG. 4, when a character/symbol embroidery pattern is selected (S12: No, S13: Yes), a character/symbol embroidery pattern display process shown in the flowchart of FIG. 8 is executed (S15).

Figure 14:
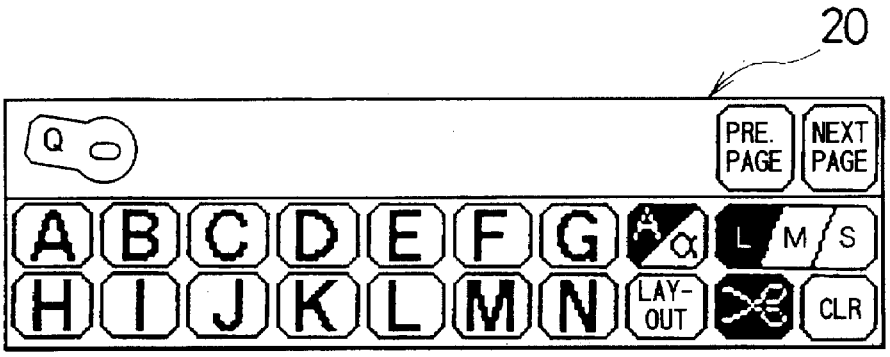
FIG. 14 is an explanatory diagram showing a set of character/symbol embroidery patterns displayed in the display unit according to the embodiment of the present invention.

When this process is started, a first set of character and symbol embroidery patterns belonging to the character/symbol category is displayed in the display unit 20 (S50). For example, as shown in FIG. 14, the first embroidery character "A" to the fourteenth embroidery character "N" that are stored in the card ROM 23 are displayed in the display unit 20.

When the "Next Page" key is depressed (S51, S52: Yes), next set of character and symbol embroidery patterns are displayed (S57). When the "Previous Page" key is depressed (S51: Yes, S52: No, S53: Yes), the previous set of character and symbol embroidery patterns are displayed (S58). When pattern selection keys are depressed, that is, when the touch keys 2O*a* corresponding to the desired characters or symbols among those displayed in the display unit 20 are depressed (S51: Yes, S52, S53: No, S54: Yes), the characters or the symbols that have been selected are displayed in the character display region of the display unit 20 (S59), whereupon the routine returns to S51. For example, when three letters "A", "B" and "C" are selected, a character string of "ABC" is displayed in the upper column of the display unit 20 as shown in FIG. 15.

When the keys other Than the "Next Page" key, "Previous Page" key, pattern selection keys and The start/stop key 21 are depressed (S51: Yes, S52 through S55: No), the process corresponding to the depressed key is executed (S56), whereupon the routine returns To S51. When the start/stop key 21 is depressed (S51: Yes, S52 through S54: No, S55: Yes), start of an embroidery stitching is instructed so as to drive the sewing machine motor 26 (S60), whereupon the routine of the character/symbol embroidery pattern display process is terminated. Then, the routine returns to S16 of the embroidery/stitching time display process and the interval interupt process is executed during execution of the stitching time computation display process as described previously.

Figure 15:
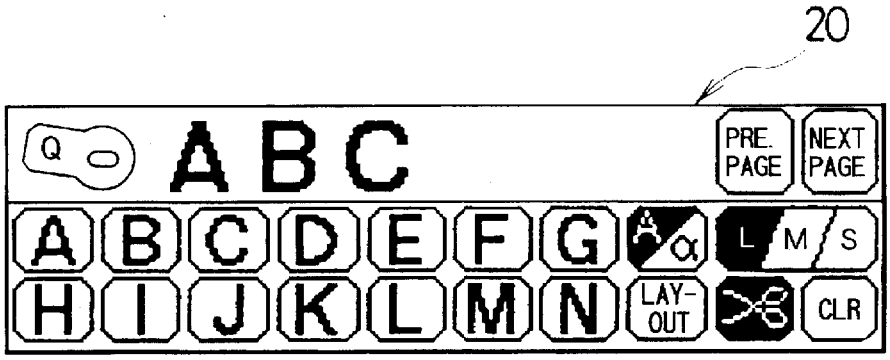
FIG. 15 is an explanatory diagram showing a set of character/symbol embroidery patterns and a selected character string "ABC" displayed in the display unit according to the embodiment of the present invention.
Figure 16:
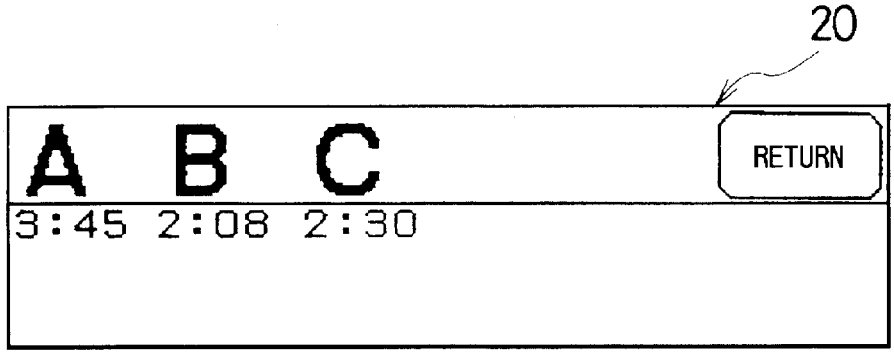
FIG. 16 is an explanatory diagram showing stitching times displayed for each of the characters.

More specifically, when the start/stop key 21 is depressed under the condition where the selected characters "ABC" are displayed in the upper column of the display unit 20 as shown in FIG. 15, the stitching mechanism is driven by the sewing motor 26 and also the workpiece cloth feeding device 40 is driven by the X- and Y-direction drive motors 42 and 43 to thereby perform the embroidery stitching. In this manner, a priority is given to the execution of the embroidery stitching relative to the execution of computation of the stitching time. The computation of the stitching time is interrupt-executed during the execution of the embroidery stitching. The stitching period of time is computed for each character, the resultant period of time is sequentially displayed in the display unit 20 in a position corresponding to the embroidery pattern as shown in FIG. 16.

While only one exemplary embodiment of this invention has been described in detail, those skilled in the art will recognize that there are many possible modifications and variations which may be made in this exemplary embodiment while yet retaining many of the novel features and advantages of the invention.

A modification may be made so that the card ROM 23 stores only the pattern display data regarding a plurality of preselected embroidery patterns and the embroidery data is obtained by developing the pattern display data. Conversely, the card ROM 23 may store only the embroidery data and the pattern display data may be obtained by developing the embroidery data. The card ROM 23 may store pattern data that can be developed into the embroidery data and the pattern display data. In the latter case, the pattern data are developed into the pattern display data and the embroidery data.

It is also possible to determine whether a stitching period of time is to be computed or not for pattern data that is automatically read from an external memory, such as card ROM. The computation of the stitching period of time can be canceled before completion of the computation.

Further, the present invention is applicable not only to electrically controlled sewing machines but also to various types of sewing machines with no provision of such a stitching mechanism, including a sewing machine that stitches an embroidery while moving a needle relative to an embroidery frame, and a sewing machine that stitches an embroidery while moving a fabric workpiece back and forth and also in left and right directions with a feed dog.

What is claimed is:

1. An embroidery stitching device comprising:

a display unit;

data storage means for storing a plurality of pieces of pattern data, each of said plurality of pieces of pattern data containing a plurality of pieces of embroidery data regarding a plurality of embroidery patterns, each of said plurality of embroidery patterns being stitched by at least one color thread;

embroidery stitching means for stitching an embroidery pattern in a workpiece cloth, said embroidery stitching means including a stitching mechanism provided with a needle, and a workpiece cloth moving mechanism for moving the workpiece cloth relative to said stitching mechanism;

stitching control means for controlling said embroidery stitching means so that the embroidery pattern is stitched in the workpiece cloth based on corresponding embroidery data stored in said data storage means;

pattern display control means for displaying a predetermined number of embroidery patterns in said display unit based on a selected one of said plurality of pieces of pattern data;

pattern selection means for selecting a desired embroidery pattern from said predetermined number of embroidery patterns displayed in said display unit;

stitching start instruction means for instructing said stitching control means to start stitching when the desired embroidery pattern is selected with said pattern selection means;

time computing means for computing a stitching period of time needed for stitching the desired embroidery pattern based on embroidery data corresponding to the desired embroidery pattern, the stitching period of time being computed in parallel relation with stitching of the desired embroidery pattern, said time computing means outputting time data representative of a computed stitching period of time; and time display control means for displaying the computed stitching period of time in said display unit based on the time data output from said time computing means.

2. The embroidery stitching device according to claim 1, wherein said stitching control means implements controlling of said embroidery stitching means through an interval interrupt during computation of the stitching period of time by said time computing means.

3. The embroidery stitching device according to claim 1, wherein said time computing means computes the stitching period of time for the desired embroidery pattern selected by said pattern selection means, and wherein said time display control means displays the computed stitching period of time in association with a corresponding embroidery pattern displayed in said display unit.

4. The embroidery stitching device according to claim 1, wherein when a plurality of embroidery patterns are sequentially selected by said pattern selection means, said time computing means computes the stitching period of time for each of the plurality of embroidery patterns selected by said pattern selection means, and wherein said time display control means displays the stitching period of time computed for each of the plurality of embroidery patterns selected by said pattern selection means in association with corresponding embroidery patterns displayed in said display unit.

5. The embroidery stitching device according to claim 1, further comprising category display control means for displaying in said display unit a plurality of categories corresponding to said plurality of pieces of pattern data, respectively, and category selection means for selecting a category out of said plurality of categories, and wherein said pattern display control means displays the predetermined number of embroidery patterns in said display unit based on one of said plurality of pieces of pattern data corresponding to the category selected by the operator.

6. The embroidery stitching device according to claim 5, wherein said category selection means comprises a plurality of touch switches provided corresponding to said plurality of categories displayed in said display unit.

7. The embroidery stitching device according to claim 6, wherein each of said plurality of touch switches comprises a transparent electrode disposed in an overlapping relation to the corresponding category displayed in said display unit.

8. The embroidery stitching device according to claim 7, wherein said data storage means stores pattern display data, embroidery pattern data, and a leading address of the embroidery pattern data with respect to each of said plurality of embroidery patterns.

9. The embroidery stitching device according to claim 8, wherein said pattern display control means comprises means for sequentially displaying said predetermined number of embroidery patterns in said display unit based on the pattern display data and the leading addresses of said plurality of embroidery patterns.

10. The embroidery stitching device according to claim 1, further comprising segmental embroidery pattern display control means for displaying segmental embroidery patterns of the desired embroidery pattern, each of said segmental embroidery patterns being extracted on a color thread basis.

11. The embroidery stitching device according to claim 10, wherein when said pattern selection means selects the desired embroidery pattern, said segmental embroidery pattern display control means displays the segmental embroidery patterns of the desired embroidery pattern.

12. The embroidery stitching device according to claim 11, wherein said segmental embroidery patterns are displayed sequentially in an order of stitching.

13. An embroidery stitching device comprising:

a display unit;

data storage means for storing a plurality of pieces of embroidery data regarding a plurality of embroidery patterns, each of said plurality of embroidery patterns being stitched by at least one color thread;

a timing generator for defining an embroidery data read timing and a workpiece cloth move timing;

embroidery stitching means for stitching an embroidery pattern in a workpiece cloth, said embroidery stitching means including a stitching mechanism provided with a needle, and a workpiece cloth moving mechanism for moving the workpiece cloth relative to said stitching mechanism;

stitching control means for controlling said embroidery stitching means so that the embroidery pattern is stitched in the workpiece cloth based on corresponding embroidery data stored in said data storage means;

pattern display control means for displaying a predetermined number of embroidery patterns in said display unit based on said plurality of pieces of embroidery data;

pattern selection means for selecting a desired embroidery pattern from said predetermined number of embroidery patterns displayed in said display unit;

stitching start instruction means for instructing said stitching control means to start stitching when the desired embroidery pattern is selected with said pattern selection means;

time computing means for computing a stitching period of time needed for stitching the desired embroidery pattern based on embroidery data corresponding to the desired embroidery pattern, said time computing means outputting time data representative of a computed stitching period of time; and time display control means for displaying the computed stitching period of time in said display unit based on the time data output from said time computing means, wherein at the embroidery data read timing, said embroidery stitching means reads embroidery data corresponding to the desired embroidery pattern from said data storage means and computes a moving distance of said workpiece cloth moving mechanism based on the embroidery data read from said data storage means, and at the workpiece cloth move timing, said workpiece cloth moving mechanism moves the workpiece cloth by the moving distance computed, and wherein at timings other than the embroidery data read timing and the workpiece cloth move timing, said time computing means computes the stitching period of time.

14. The embroidery stitching device according to claim 13, wherein said stitching control means actuates said stitching mechanism when start of stitching is instructed by said stitching start instruction means.

15. The embroidery stitching device according to claim 13, wherein said time computing means computes the stitching period of time for the desired embroidery pattern selected by said pattern selection means, and wherein said time display control means displays the computed stitching period of time in association with a corresponding embroidery pattern displayed in said display unit.

16. The embroidery stitching device according to claim 13, wherein when a plurality of embroidery patterns are sequentially selected by said pattern selection means, said time computing means computes the stitching period of time for each of the plurality of embroidery patterns selected by said pattern selection means, and wherein said time display control means displays the stitching period of time computed for each of the plurality of embroidery patterns selected by said pattern selection means in association with corresponding embroidery patterns displayed in said display unit.

17. The embroidery stitching device according to claim 16, further comprising selected pattern display control means for displaying said plurality of embroidery patterns selected by said pattern selection means.

* * * * *